US006366313B1

(12) United States Patent
Hall

(10) Patent No.: US 6,366,313 B1
(45) Date of Patent: Apr. 2, 2002

(54) HEIGHT-ADJUSTABLE SUPPORT ASSEMBLY, PARTICULARLY SUITED FOR FOOD PROCESSING EQUIPMENT

(76) Inventor: Donald M. Hall, P. O. Box 1548, Kingston, NY (US) 12402-1548

( * ) Notice: Subject to any disclaimer, the term of this patent is extended or adjusted under 35 U.S.C. 154(b) by 0 days.

(21) Appl. No.: 09/716,214

(22) Filed: Nov. 21, 2000

Related U.S. Application Data

(60) Provisional application No. 60/042,471, filed on Mar. 27, 1997.

(51) Int. Cl.[7] ..... F16M 11/26
(52) U.S. Cl. ..... 348/188.5; 248/125.8
(58) Field of Search ..... 248/188.5, 405, 248/159, 157, 295.11, 436, 200.1, 125.8, 354.1

(56) References Cited

U.S. PATENT DOCUMENTS

| | | | | |
|---|---|---|---|---|
| 222,681 A | | 12/1879 | Earle | |
| 2,623,256 A | | 12/1952 | Feibelman | 24/208 |
| 3,796,169 A | | 3/1974 | Bales et al. | 108/116 |
| 4,744,536 A | * | 5/1988 | Bancalari | 248/125 |
| 4,807,837 A | * | 2/1989 | Gawlik et al. | 248/125 |
| 5,141,197 A | | 8/1992 | Mackaay | 248/439 |
| 5,340,143 A | * | 8/1994 | Williams, Jr. | 280/475 |
| 5,520,360 A | * | 5/1996 | Wensman | 248/354.5 |
| 5,558,501 A | * | 9/1996 | Wang et al. | 416/244 R |
| 5,640,986 A | * | 6/1997 | Herman | 135/68 |
| 6,019,484 A | * | 2/2000 | Seyler | 362/287 |
| 6,024,348 A | * | 2/2000 | Ventura et al. | 269/17 |
| 6,027,086 A | | 2/2000 | Heitlinger et al. | 248/188.5 |
| 6,035,589 A | | 3/2000 | Schmucki et al. | 52/126.1 |
| 6,039,293 A | | 3/2000 | Minet | 248/125.8 |
| 6,234,430 B1 | * | 5/2001 | Turner, Sr. | 248/125.8 |
| 6,234,453 B1 | * | 5/2001 | Block | 254/285 |

* cited by examiner

*Primary Examiner*—Ramon O. Ramirez
*Assistant Examiner*—A. Joseph Wujciak
(74) *Attorney, Agent, or Firm*—Shlesinger, Arkwright & Garvey LLP

(57) ABSTRACT

This invention pertains to a device having a first and second upright, a support rail connecting the first upright and the second upright, and a vertical spacer having a first edge, a second edge and a bearing surface. A height-adjustable leg may be provided between the support rail and the ground. The height-adjustable leg may be made of three(3) cooperating members, such as three interfitting tubes that may mate to form a triple walled support. A portion of the first edge of the vertical spacer is disposed on the first upright and a portion of the first edge is disposed on the second upright. A guide rail having a top surface is disposed along the second edge of the vertical spacer. The guide rail extends over the bearing surface. The device further includes a sliding support member having a first roller, a second roller and a third roller. The first roller engages the top surface of the guide rail and is oriented for transmitting substantially only vertical forces from the sliding support member to the top surface. The second roller engages the support rail and is oriented for transmitting substantially only horizontal forces from the sliding support member to the support rail. The third roller is disposed beneath the top surface of the guide rail and the first roller, and engages the bearing surface of the vertical spacer. The third roller is oriented for transmitting substantially only horizontal forces from the sliding support member to the bearing surface section.

22 Claims, 19 Drawing Sheets rail w/o pulley

By providing locking bolts, the height of each leg assy. can be adjusted to compensate for floor conditions.

(2) O.D. engages (1) I.D.

(2) I.D. engages (3) O.D.

(A) I.D. slightly larger than (B) O.D.
(B) I.D. slightly larger than (C) O.D.

Male Post Assy.
NO.1

Floor Socket Detail

Alternate Design Post
(no core drill)

HEIGHT-ADJUSTABLE SUPPORT ASSEMBLY, PARTICULARLY SUITED FOR FOOD PROCESSING EQUIPMENT

CROSS REFERENCE TO RELATED APPLICATIONS

This application claims the priority of application Ser. No. 09/049,128, filed Mar. 27, 1998, now U.S. Pat. No. 6,149,120, issued Nov. 21, 2000, which application Ser. No. 09/049,128 claims the priority of application Ser. No. 60/042,471, filed Mar. 27, 1997, and each of which is incorporated herein by reference.

FIELD OF THE INVENTION

This invention relates to devices for enhancing the movement of objects relative to other objects. In particular, this invention relates to moving devices relative to delicatessen is counters. More particularly, this invention relates to a "low-profile"frame assembly upon which a support member will slide, and adjustment of the assembly.

OBJECT OF THE INVENTION

It is an object of the present invention to provide a sliding shelf system having a frame with an overall lower height and width than conventional frames.

A still further object of the present invention is to provide a slidable shelf system, which has a curved form for guiding a slidable support member on a curved path rather than a linear path.

Another object of this invention is to provide a low profile slidable shelf system that is easier to install than conventional devices.

Yet another object of the present invention is to provide a frame support for a slidable work member, which does not have to be core drilled into the work area floor.

A further object of the present invention is to provide a low profile slidable shelf that will prevent the inadvertent removal of the sliding shelf from the frame.

A still a further object of the present invention is to provide a low profile slidable shelf system which is vibration resistant.

Another object is to provide a fine-tuning mechanism for adjusting the height of shelf system.

Yet another object of the present is to provide a low profile slidable shelf system, which is more economical to manufacture, install and maintain than conventional systems.

BRIEF DESCRIPTION OF THE DRAWINGS

Various inventive features are set forth below and in the following.

FIG. 1 is an end view of my new low profile sliding shelf system.

FIG. 2 is an enlarged end view of the system of FIG. 1, illustrating how the siding work assembly engages the frame.

FIG. 3 is an end view of the frame component of FIG. 1.

FIG. 4 is an enlarged partial cross sectional view of the top roller, which rides or engages the round tube or guide of the frame of FIG. 2.

FIG. 5A is an enlarged front elevational view of the interlocking sleeve assembly, of the frame, for mounting the frame to the floor.

FIG. 5B is a perspective view of the interlocking sleeve assembly of FIG. 5A.

FIG. 6 is an exploded view of the interlocking sleeve assembly of FIG. 5A.

FIG. 7 is an exploded view of the interlocking sleeve illustrating how the height of each leg or upright, of the frame, can be adjusted.

FIG. 8 is an exploded view of the interlocking sleeve assembly of FIG. 5A.

FIG. 9 is an exploded view of the interlocking sleeve assembly of FIG. 5A.

FIG. 10 is a front elevational view of the frame.

FIG. 11 is an exploded view of a component of the frame of FIG. 5A.

FIG. 12 is an enlarged front elevational view of the male post assembly component of the interlocking sleeve assembly of the frame of FIG. 10.

FIG. 13 is an enlarged view of a portion of the interlocking sleeve assembly of the frame of FIG. 10.

FIG. 14 is an enlarged front elevational view of the floor socket component of the interlocking sleeve assembly of FIG. 11.

FIG. 15 is an elevational view of an alternative mounting design for mounting the frame to the floor.

FIG. 16 is a perspective view of the mounting of FIG. 15.

FIG. 16B is a front elevational view of the mounting of FIG. 15.

FIG. 17 is an end view similar to FIGS. 2 and 3, illustrating another preferred embodiment of a frame component according to the invention.

FIG. 18 illustrates the manner in which elements A and C engage element B of the exploded view of FIG. 17.

FIG. 19 is a further exploded view of the embodiment of FIG. 17.

FIG. 20 is a further view, similar to FIG. 18, on a reduced scale.

FIG. 21 is a partial perspective view of the embodiment of FIG. 17.

FIG. 22 illustrates another preferred embodiment of a frame component or upper rail assembly according to the invention.

FIG. 23 illustrates a portion of an interlocking sleeve assembly including detachably attached upper and lower portions that provide for varying the height of the rail assembly relative to the ground (i.e., the support surface), the upper portion being as shown in FIG. 22.

FIG. 24 is a cross sectional view of the interlocking sleeve assembly taken along line 24—24 of FIG. 23.

FIG. 25 illustrates how fasteners, such as the illustrated is pins, can be used to secure the lower portion 170 of the interlocking sleeve assembly of FIG. 23 to the support surface.

FIG. 26 illustrates another preferred embodiment of the lower portion of the interlocking sleeve assembly that has no fasteners on its lower portion for securing the lower portion of the sleeve assembly to the upper portion of the sleeve assembly.

DESCRIPTION OF THE PREFERRED EMBODIMENT

My new low profile frame is user friendly in that the exposed rail, the portion of the frame where the support member is not located, is lower than conventional frames, so that the user does not have to go through great efforts to reach a nearby display case.

Figure 1:
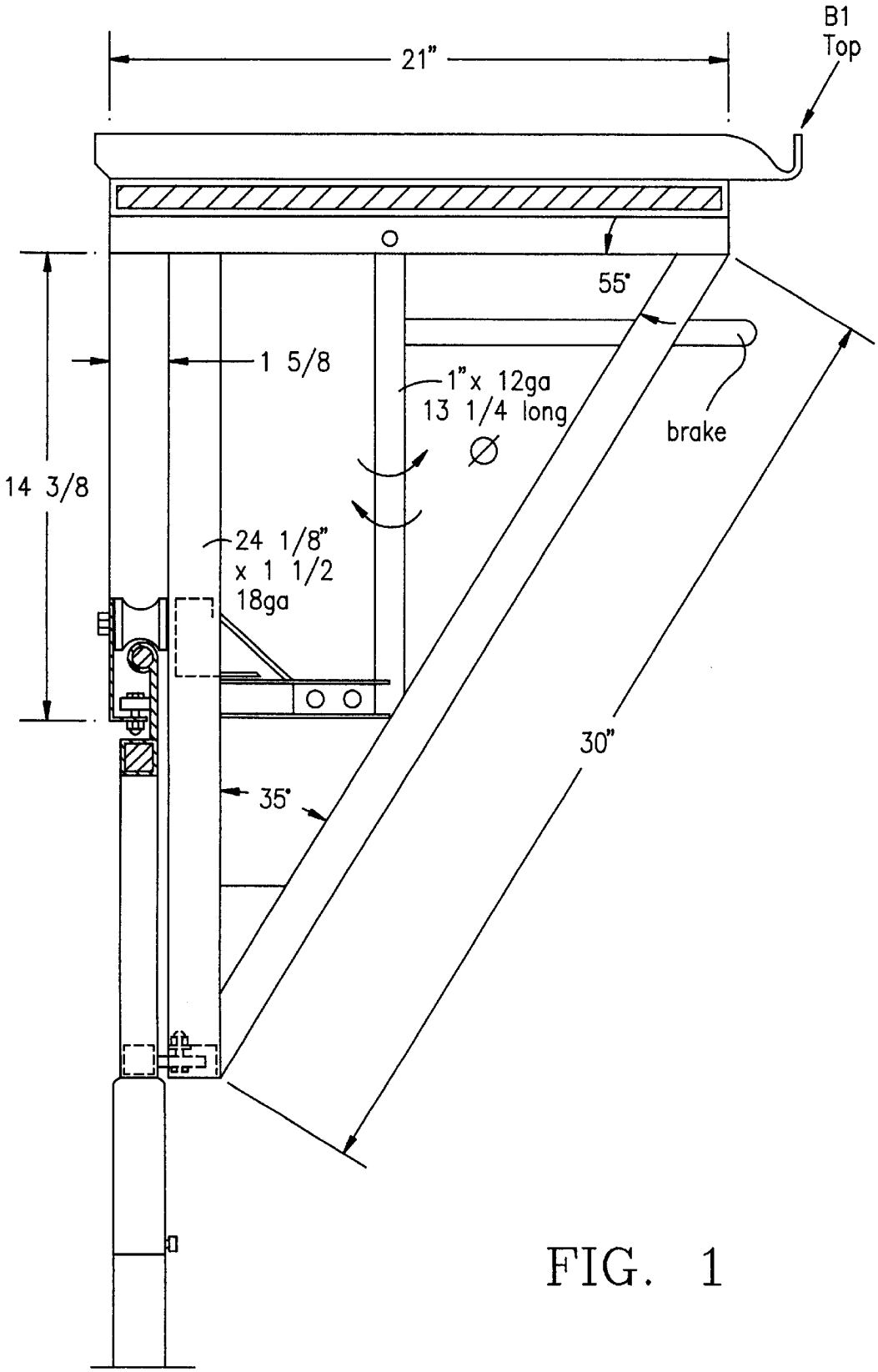
FIGS. 1, 2, 3, 4, 5A, 5B, 6, 7, 8, 9, 10, 11, 12, 13, 14, 15, 16A, 16B, 17, 18, 19, 20, 21, 22, 23, 24, 25, 26.
Figure 2:
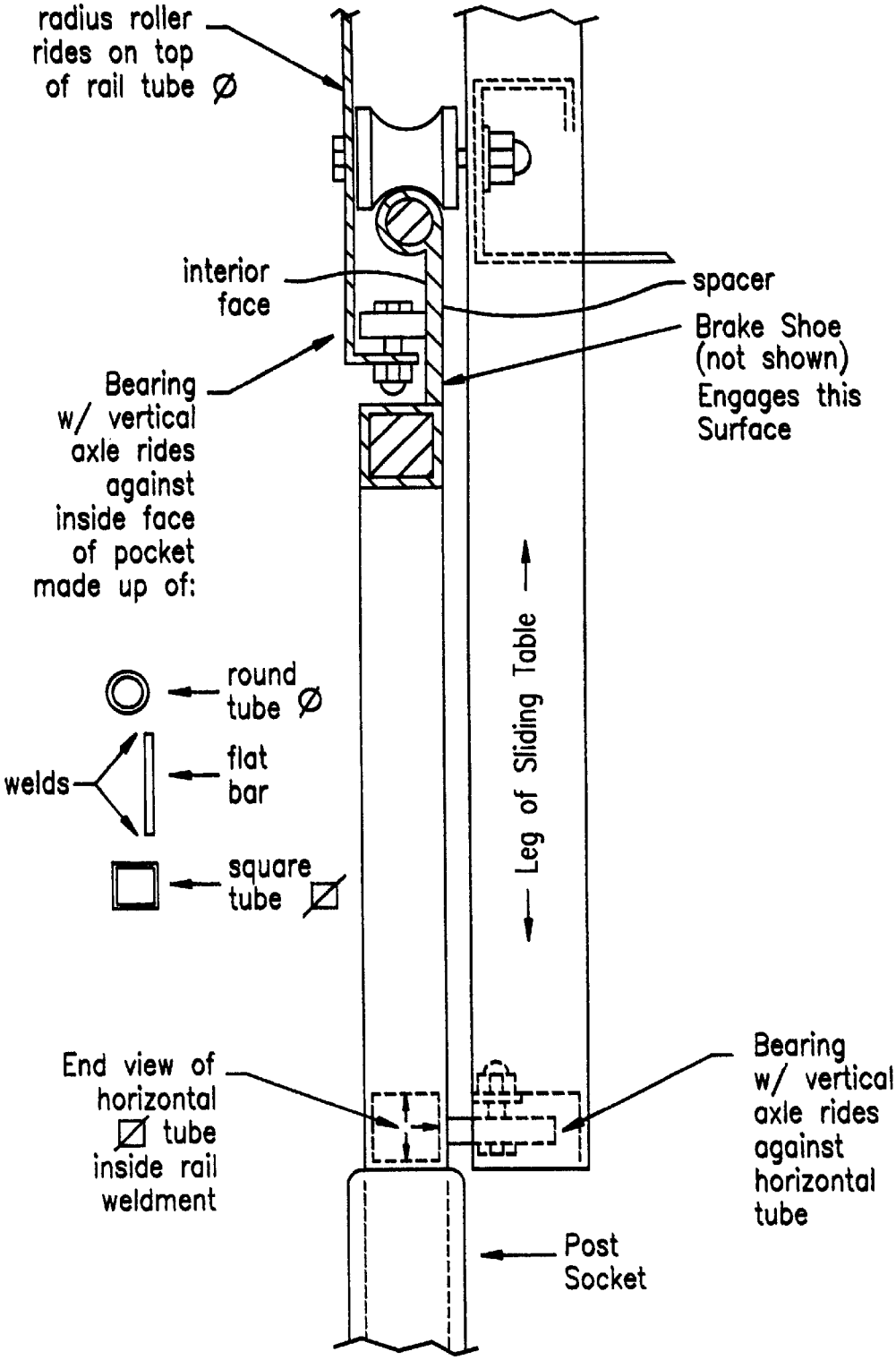
Figure 3:
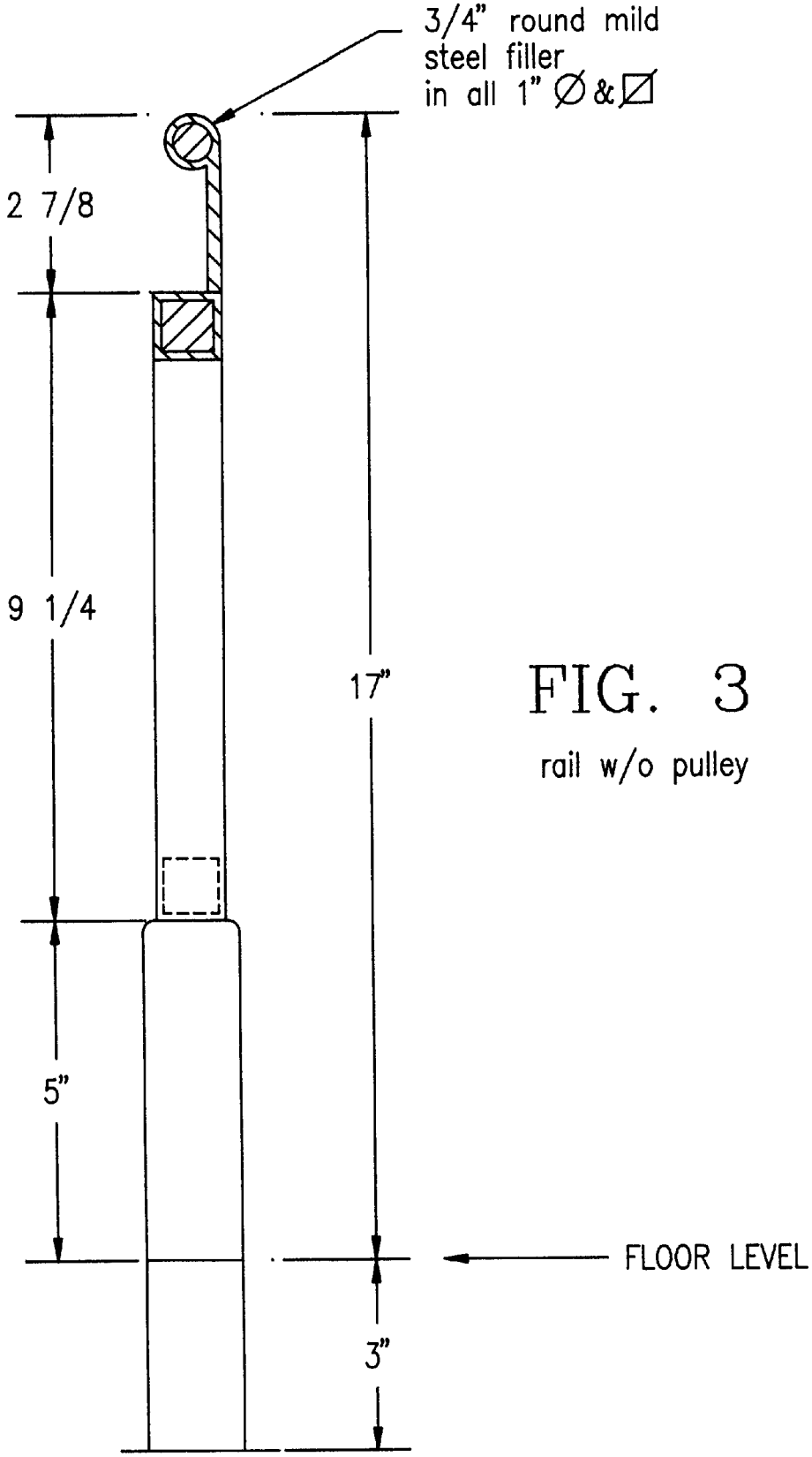

As shown in FIGS. 1, 2 and 3, my new low profile frame employs round tubes, which help isolate vibration and allow the frame to have a curved shape, so that the work surface, supported by the support member, can be slid to various locations along two perpendicular, or nonlinear, display cases.

My new low profile frame also may employ interlocking sleeve assemblies for mounting the frame to a work area floor, as disclosed in FIGS. 5–14 and 22–26. This mounting design allows for easier installation of the frame to a work floor than conventional systems, because core drilling into the flooring is not required. In other words, the interlocking sleeve can be simply bolted to the floor, rather than having to be partially inserted into the floor.

Figure 15:
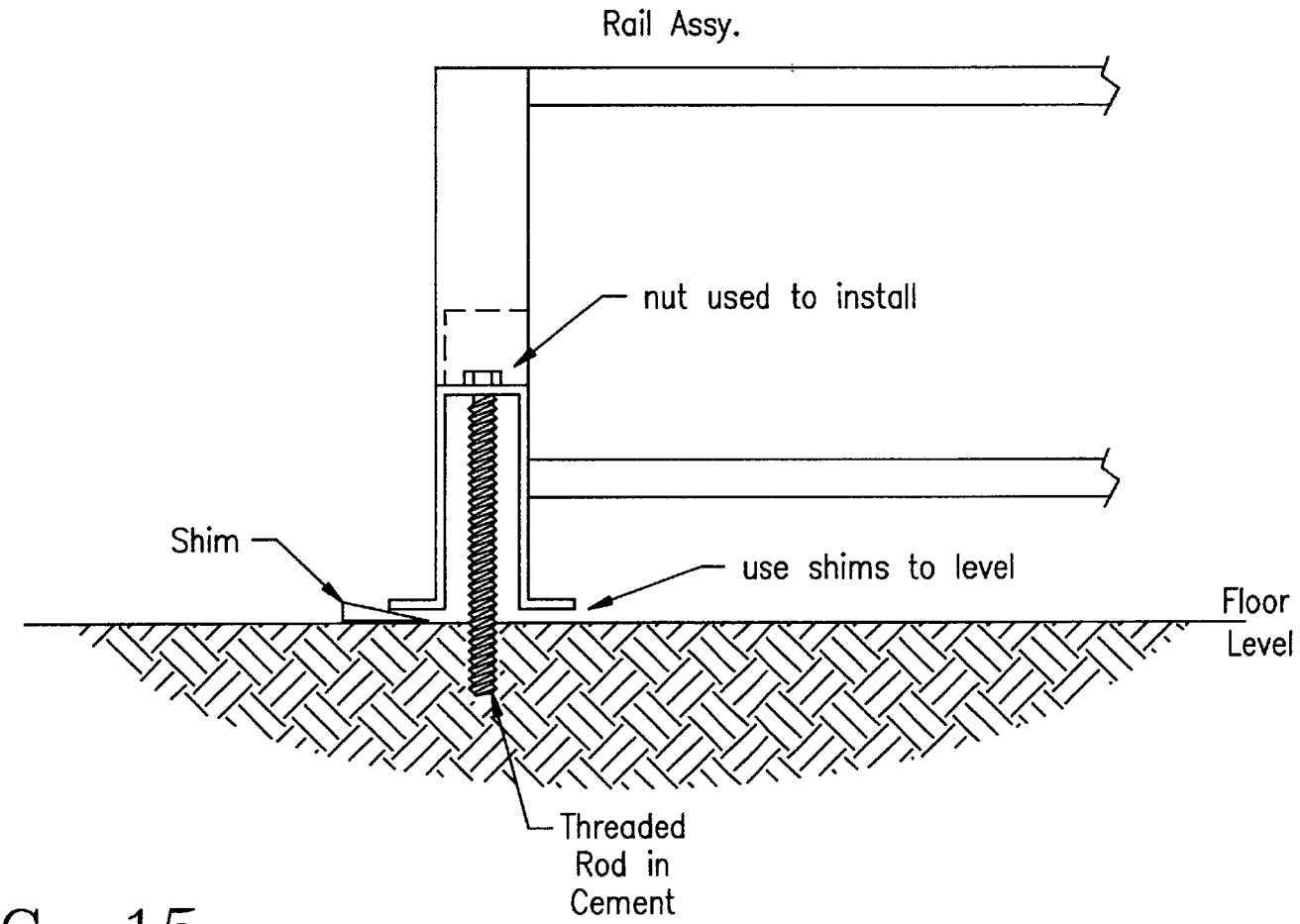
Figure 16B:
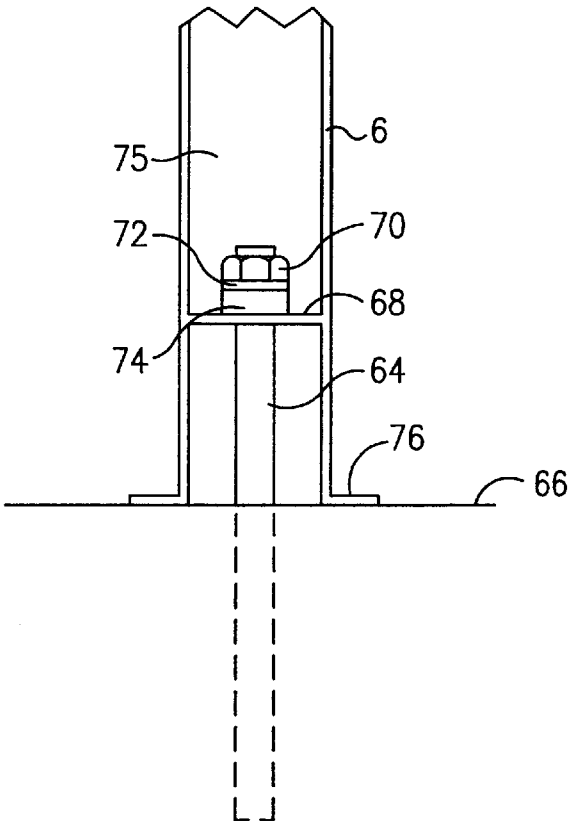
Figure 16A:
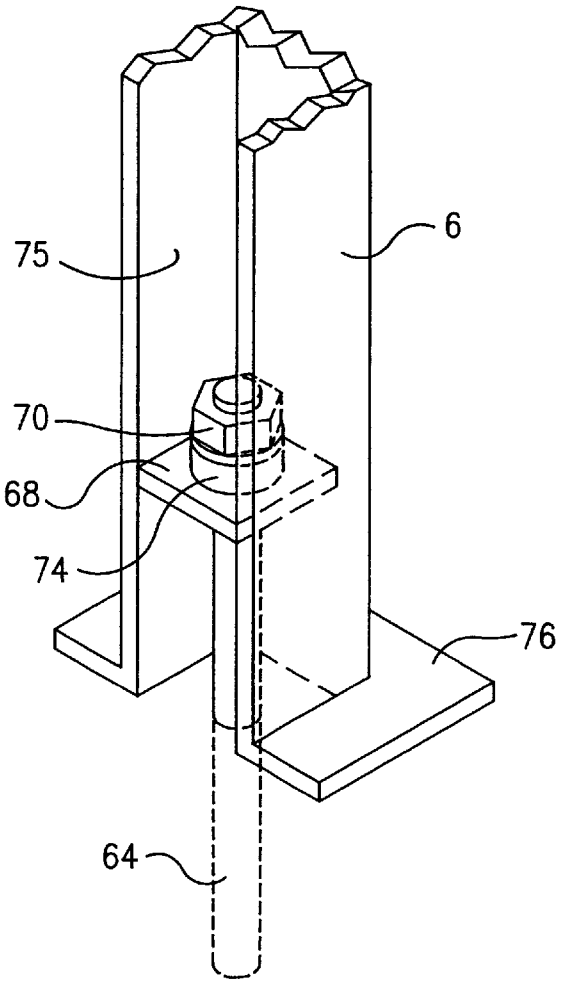
Figure 17:
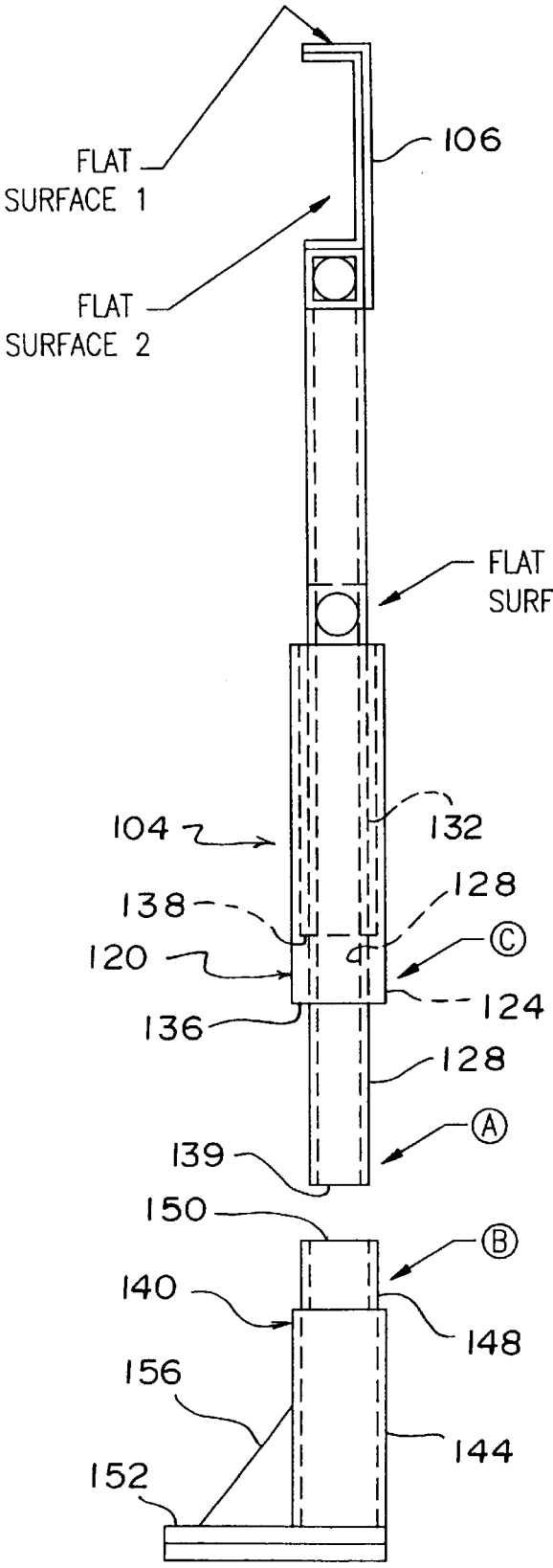
Figure 18:
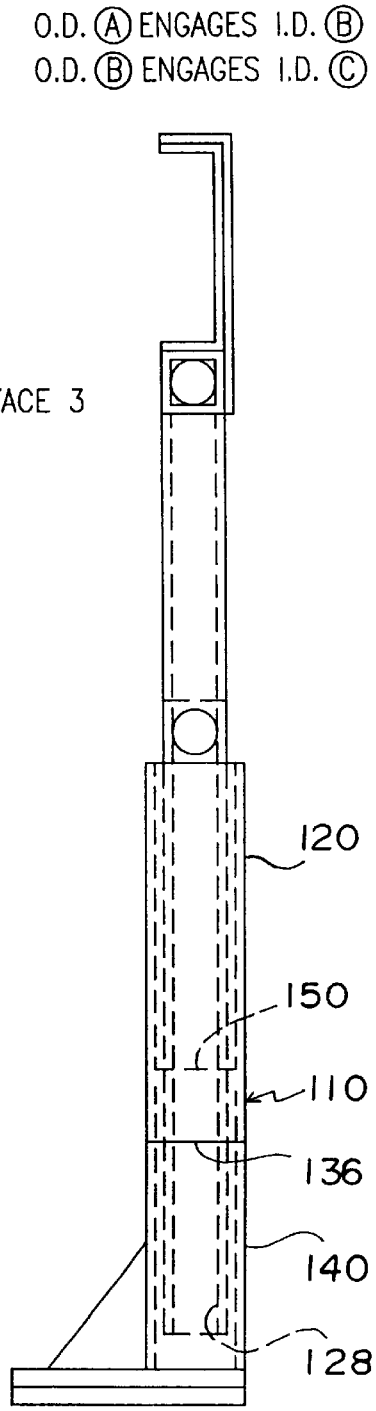
Figure 19:
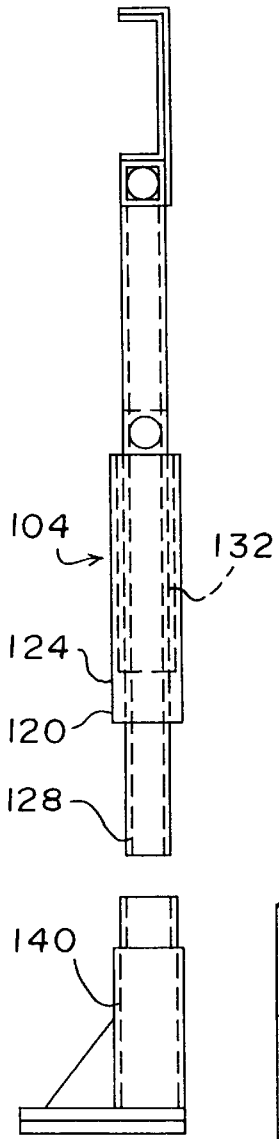
Figure 21:
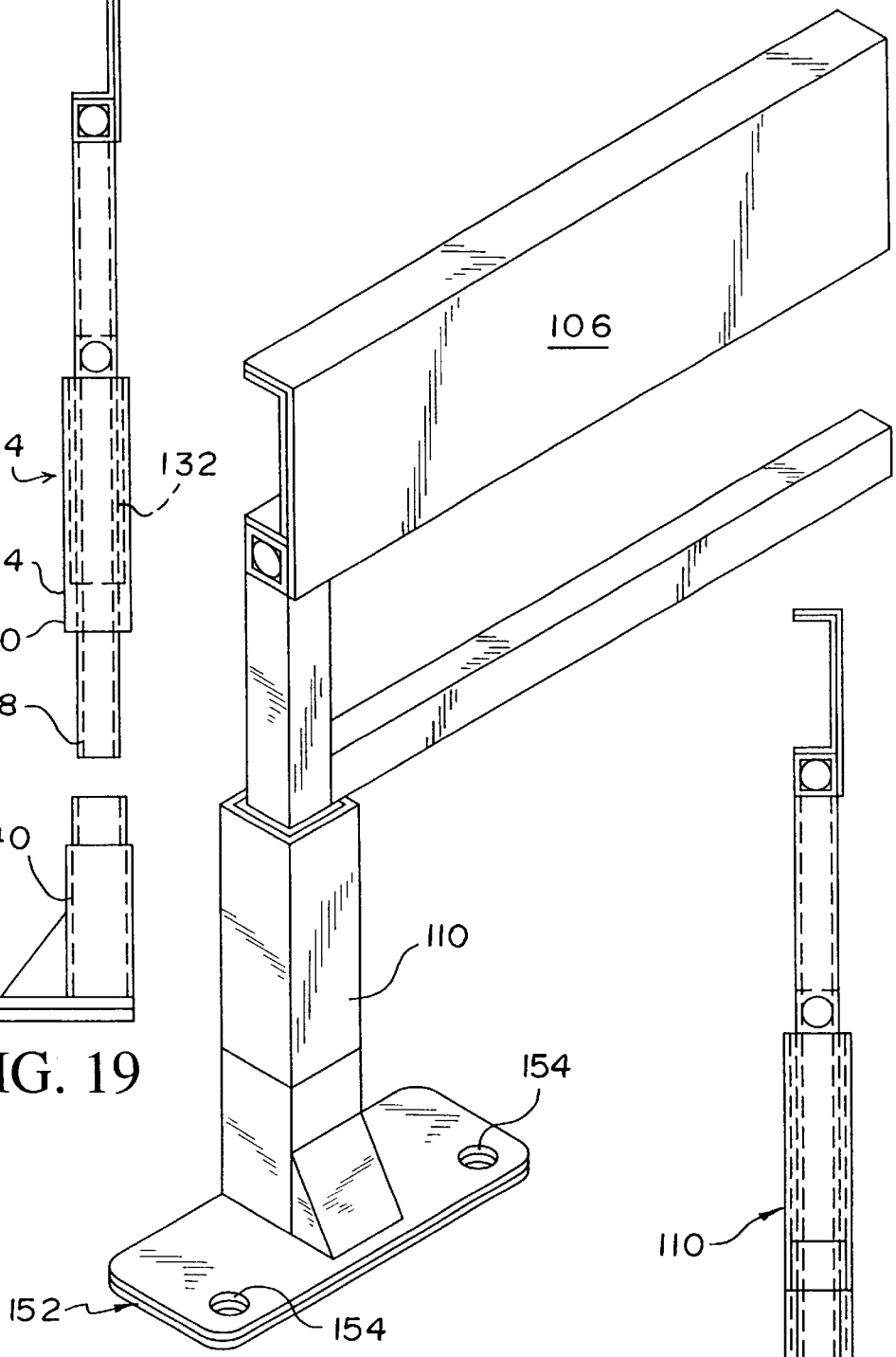
Figure 20:
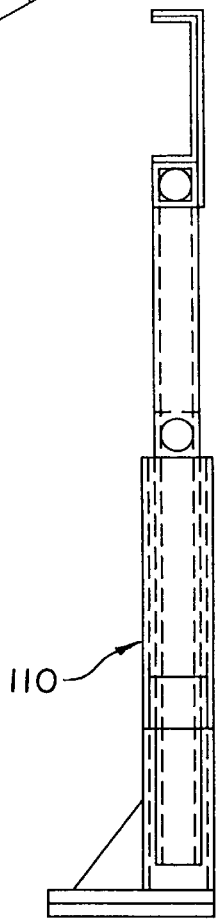
Figure 22:
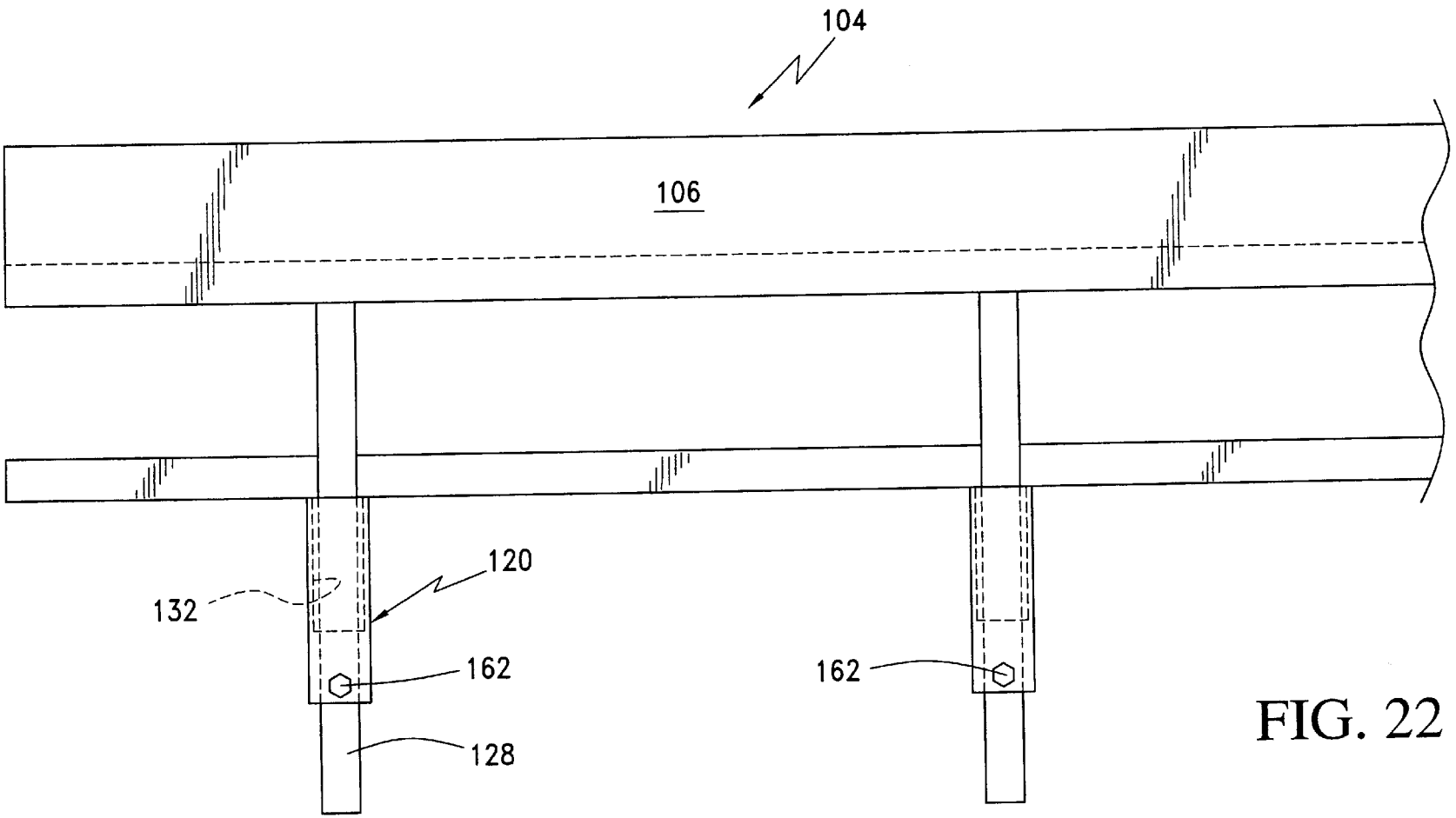

The frame can also be attached to the floor with a threaded rod or screw that is drilled into the flooring of the work area, as shown in FIGS. 15, 16A and 16B. Referring specifically to FIGS. 16A an 16B, a threaded rod 64 is shown extending from the floor line 66 into the upright 6, of the frame. To lock or secure the upright 6 to the rod 64, the upright 6 has a horizontal member 68 that the rod 64 extends through. Then a nut 70, a washer 72 and a rubber dampener 74 are threaded on to the rod 64. The rubber dampener 74 will help eliminate vibration transfer from the floor to the upright 6.

To tighten and loosen the nut 70, the upright 6 may have an open face 75. In other words, only a portion of the wall of the upright 6 may be removed to allow access to the nut 70.

To stabilize the upright 6, it has a flange 76 located at its base for engagement with the floor much like the mounting plates 34 discussed above. Some work area floors are not perfectly level. As such, it is possible that the flange 76 may not completely engage the floor. Thus, shims, shown in FIG. 15 are employed, by wedging the shims under the flanges 76, to level the upright 6 or compensate for the varying contours of the floor.

My new low profile frame provides a reduction in overall height of about 30 to 50 percent, from the conventional frame. More particularly, the height of a prototype of my invention is about 13 inches to about 17 inches, rather than the height of about 26 inches for conventional frames.

My new low profile frame provides a reduction in overall distance from back of deli case to front of rail by about 40 to about 50 percent, as compared to a conventional frame.

More particularly, the overall distance from the back of a deli case to the front of rail, or frame, will be reduced from the about 5.5 inches required for a conventional frame, to about 3 inches.

Figure 4:
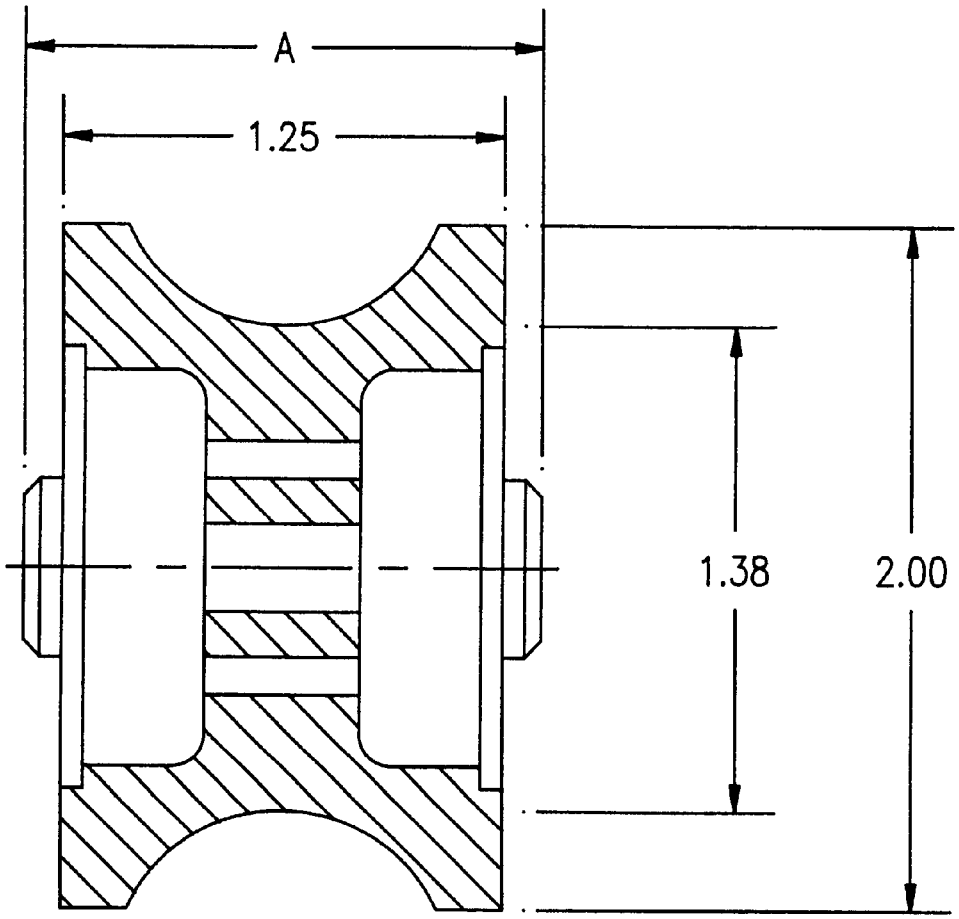
Figure 5B:
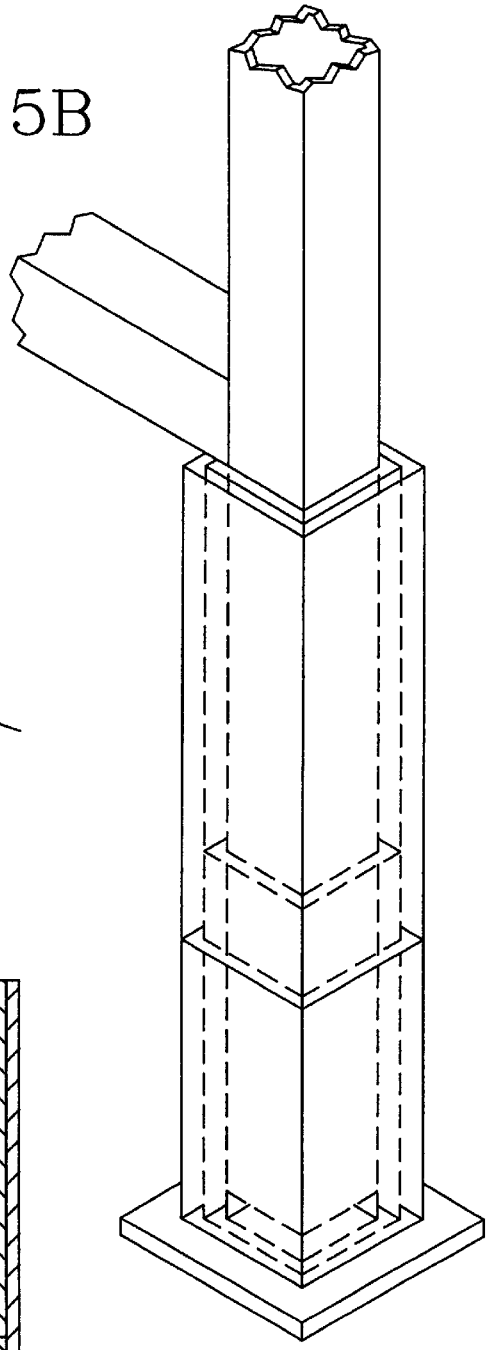
Figure 5A:
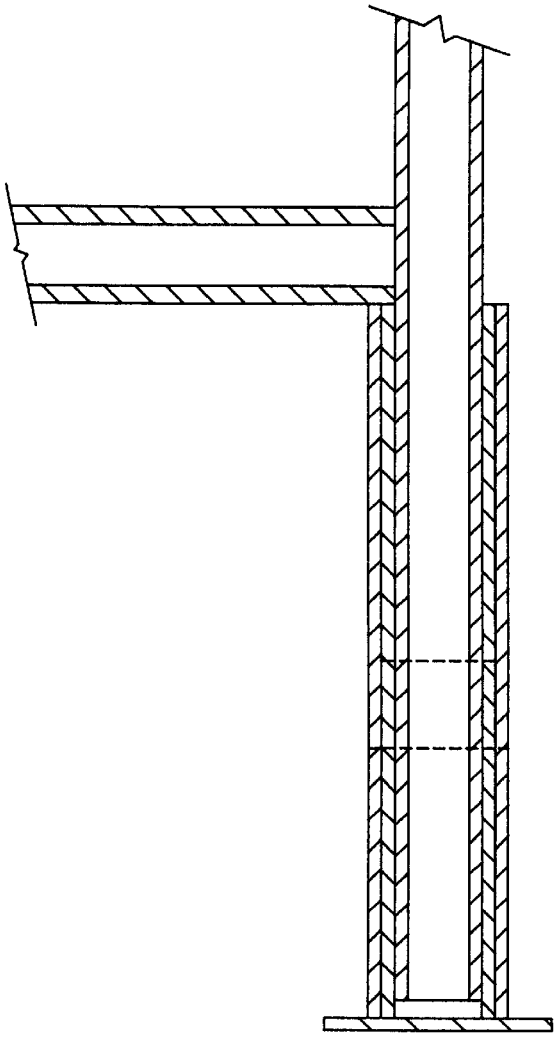
Figure 6:
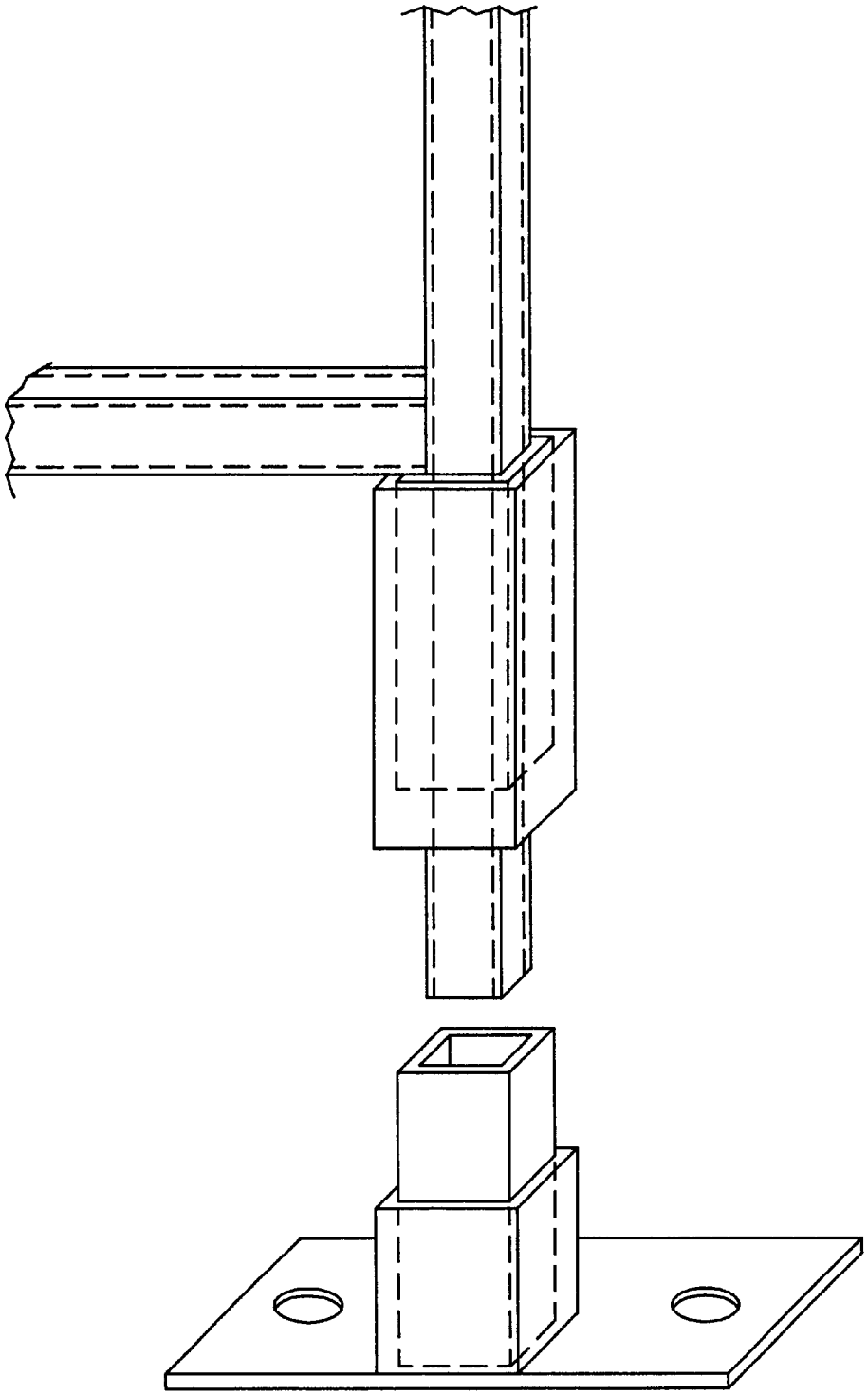
Figure 7:
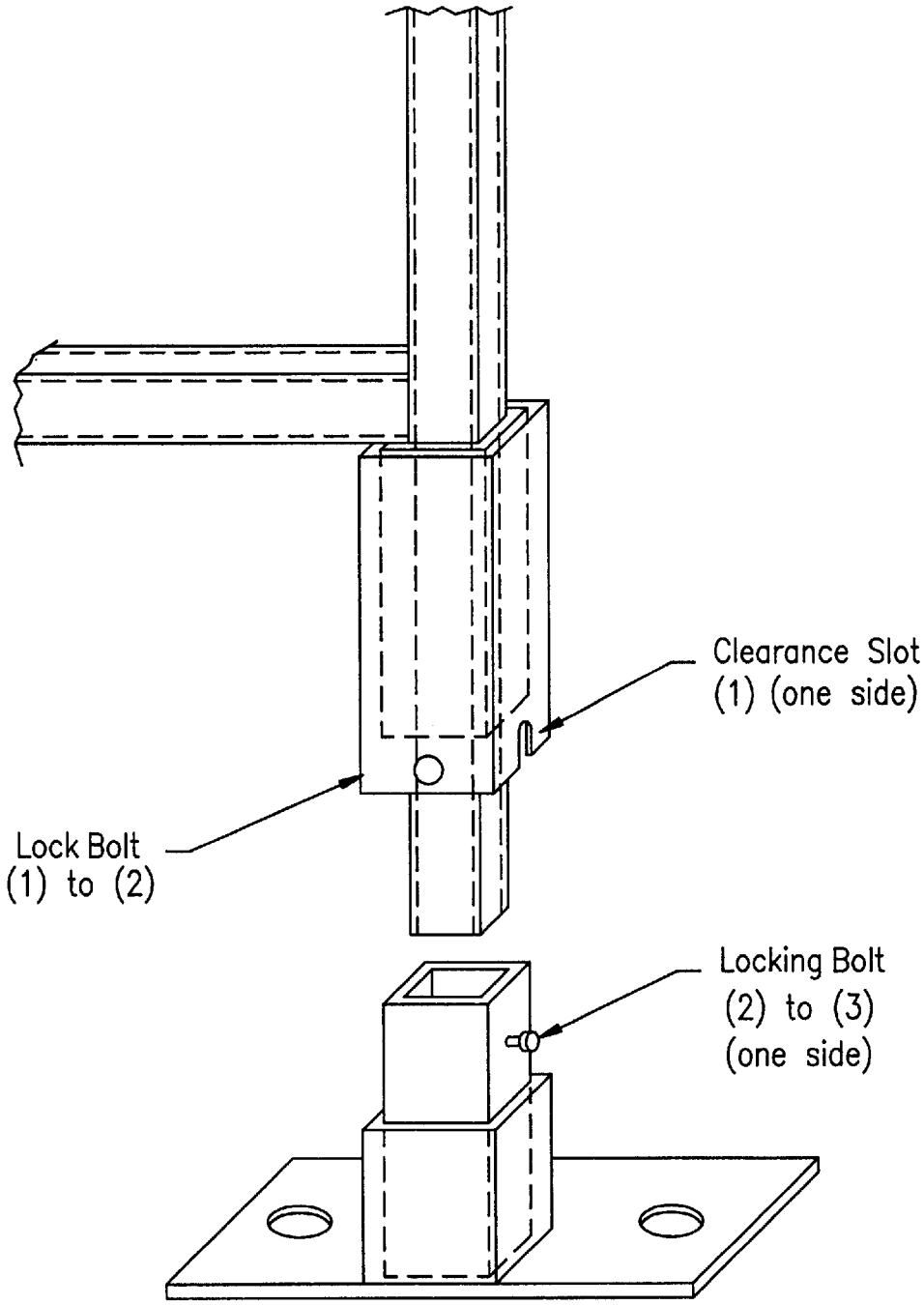
Figure 8:
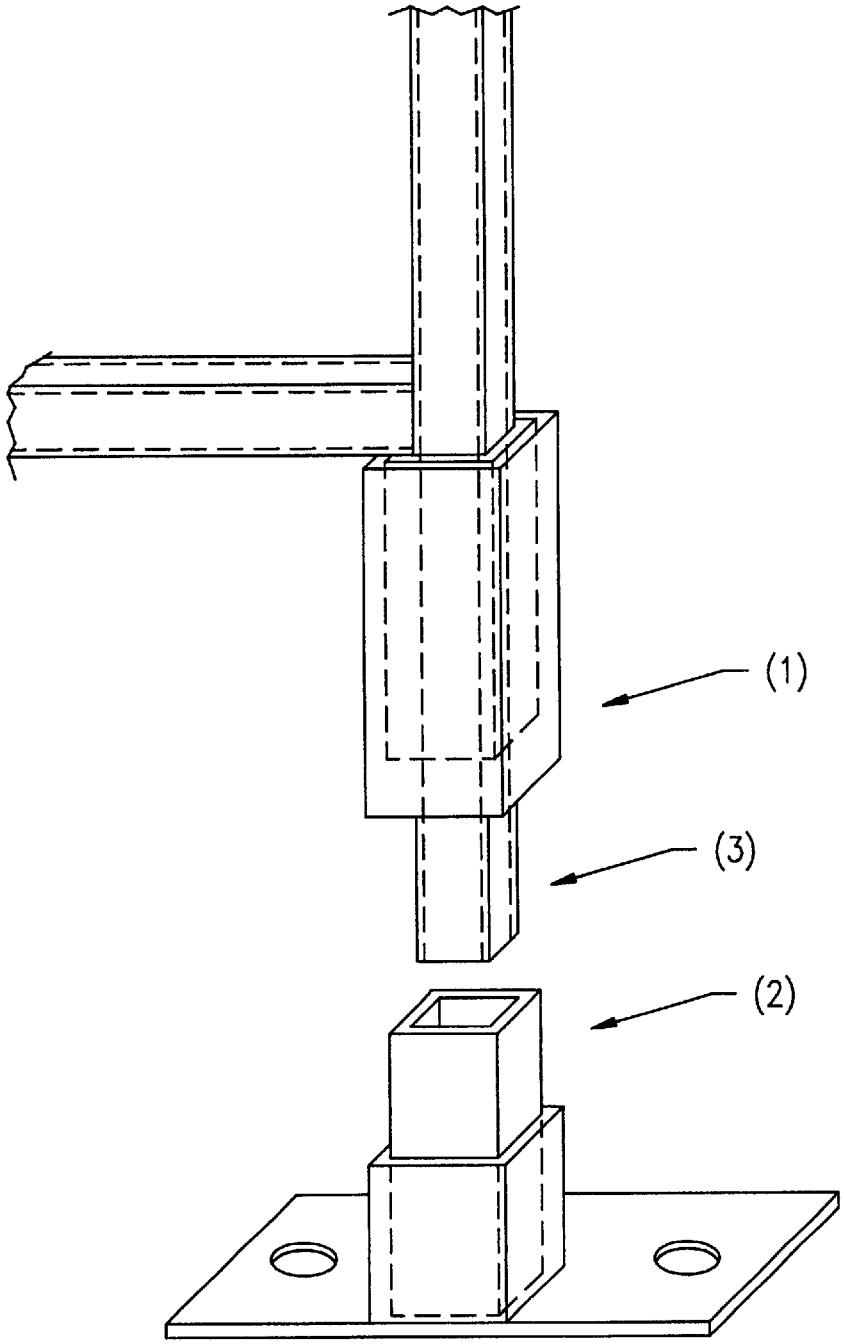
Figure 9:
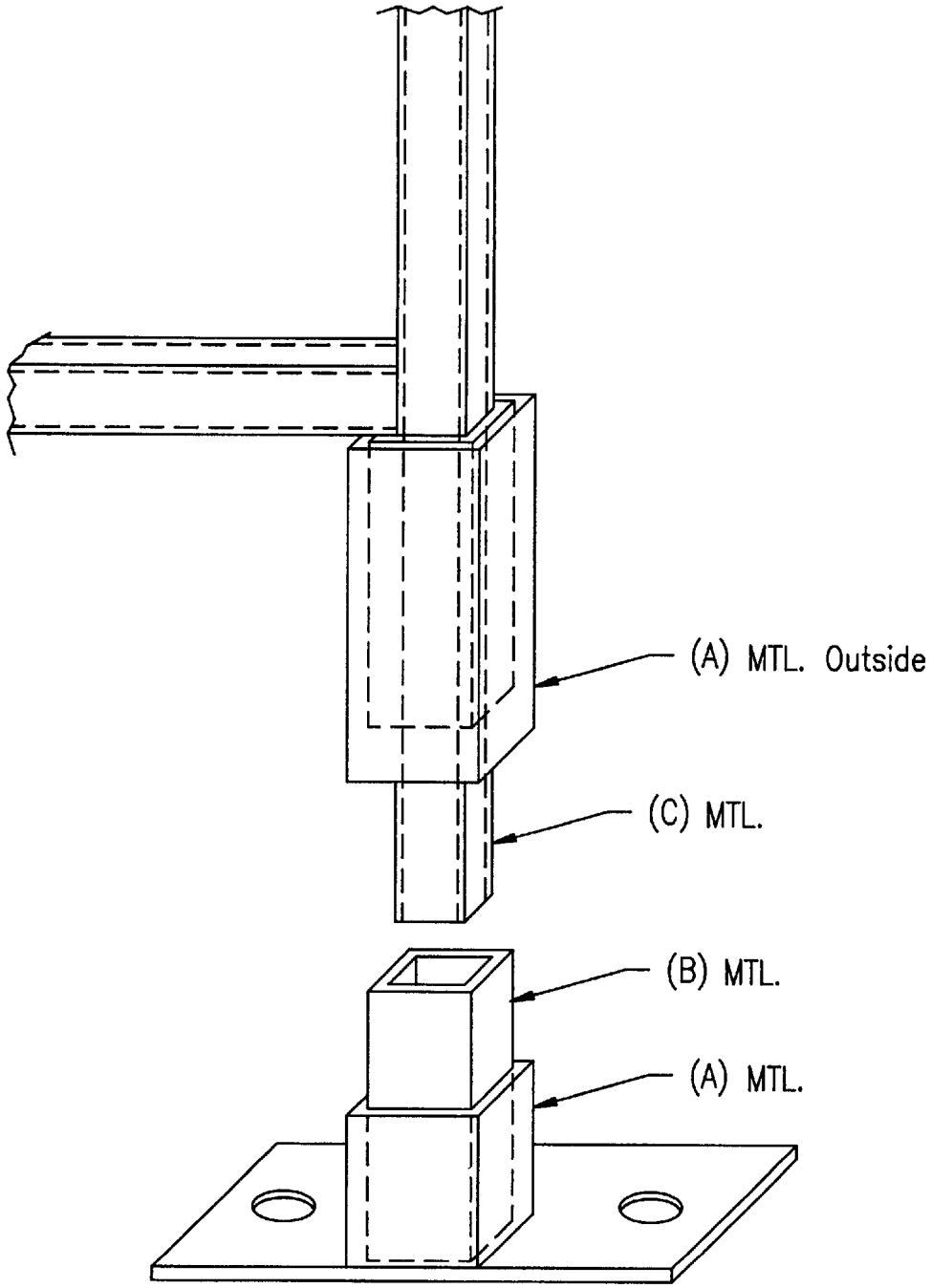
Figure 10:
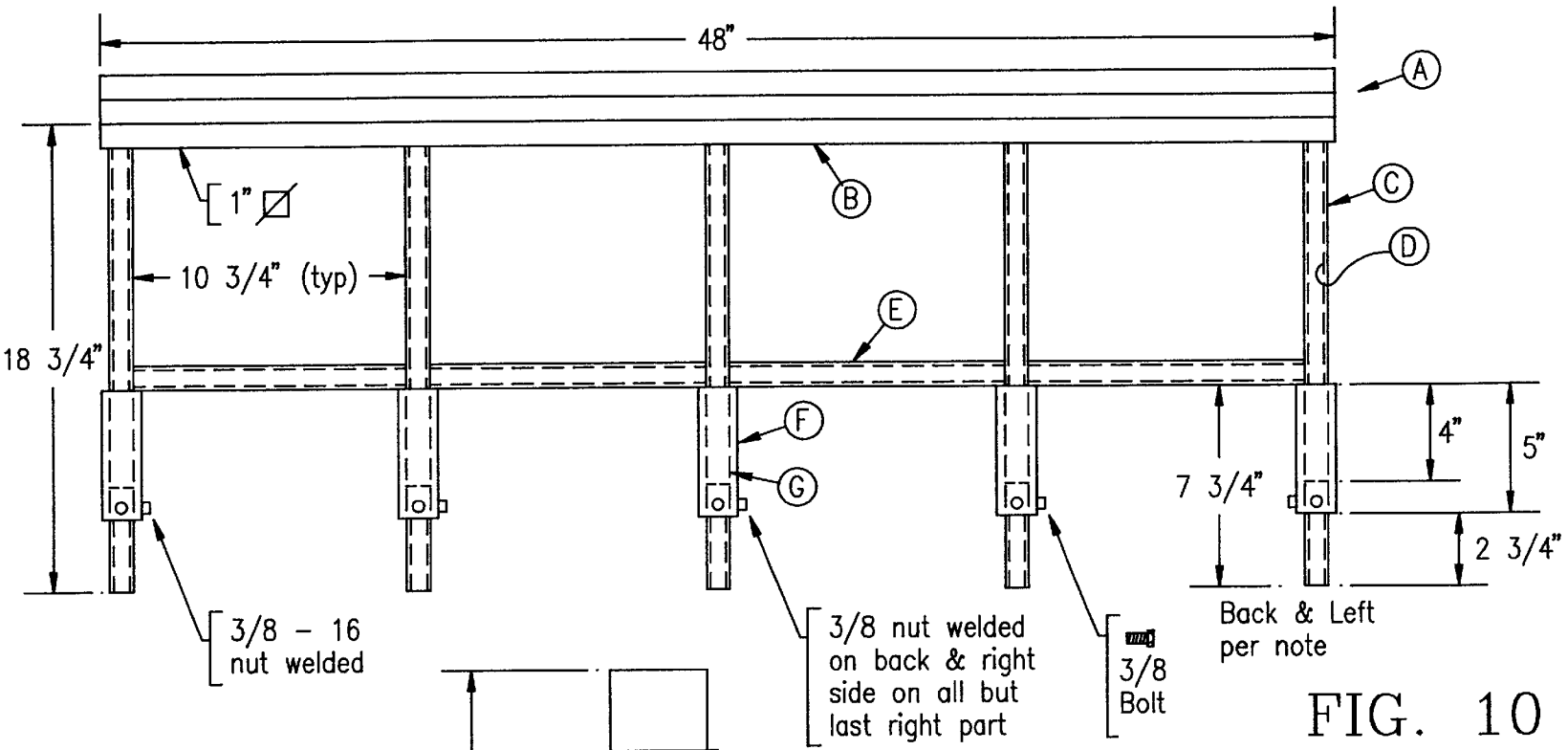
Figure 11:
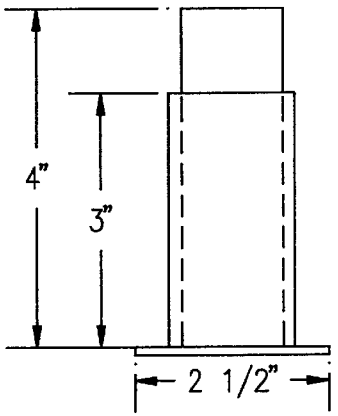
Figure 12:
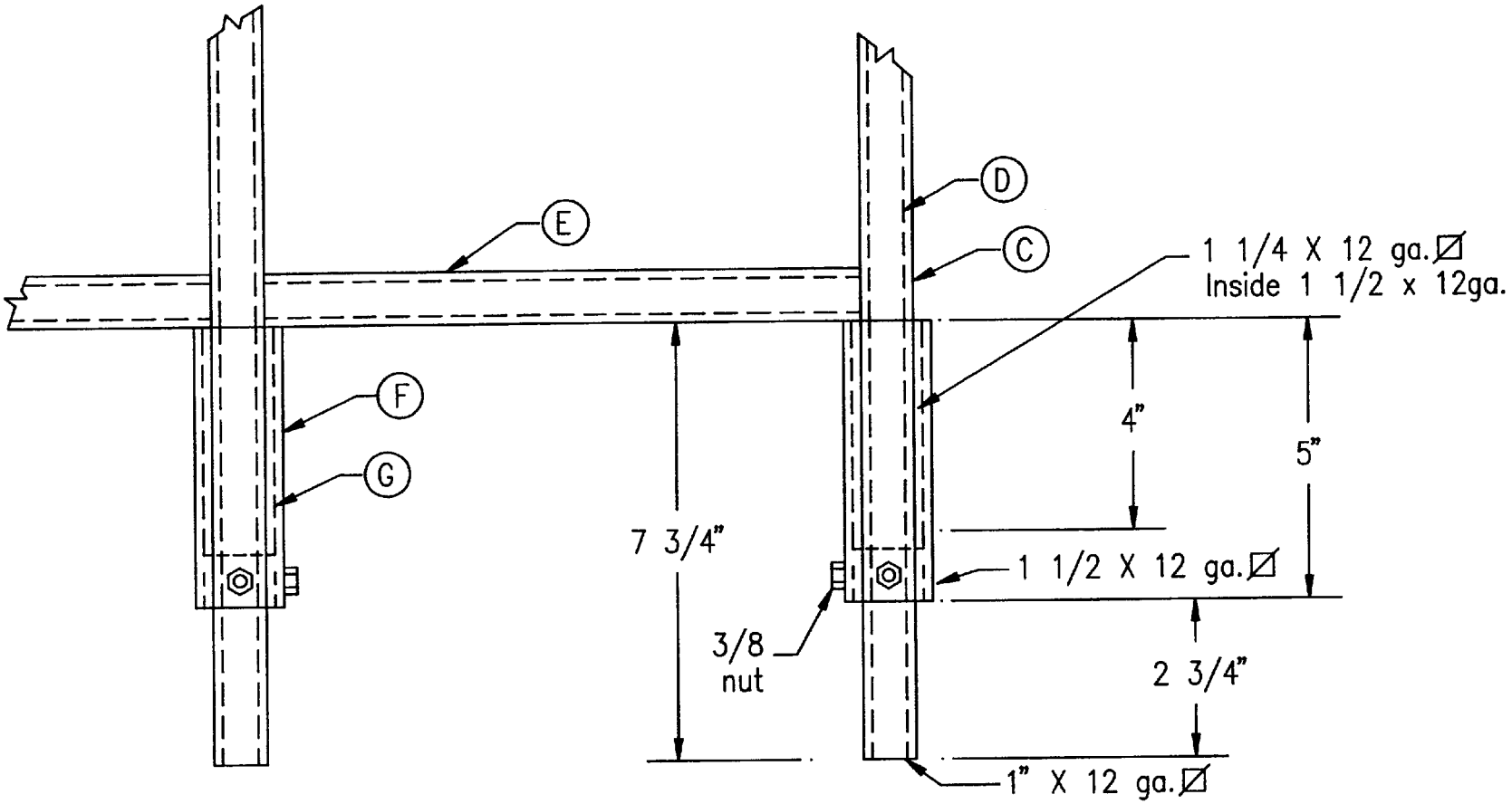
Figure 13:
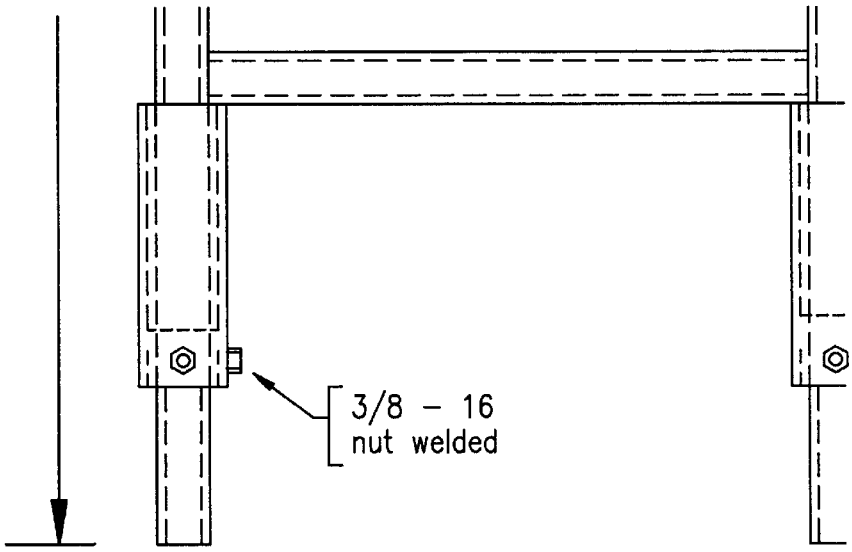
Figure 14:
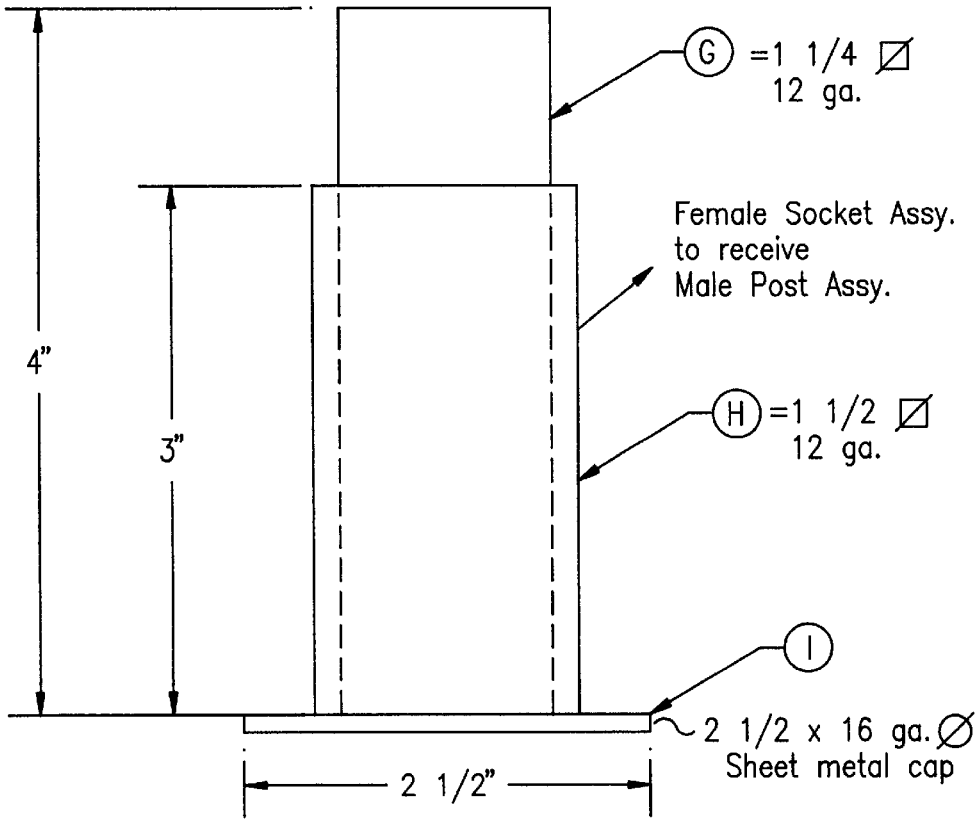

To further reduce vibration transfer from the ground to the support member, which slides along the frame, vibration absorbing wheels can be employed for all the rollers engaging the frame, and in particular for the top roller as shown in FIGS. 1, 3 and 4.

My new low profile frame also has a smaller floor plate for ease of cleaning the floor.

Additionally, to reduce vibration transfer from the ground through the frame, the frame members are preferably hollow. The walls of the frame members are preferably made of the three layers of dissimilar materials. The hollow potion of the frame members can be filled with vibration absorbing material such as lead shot or foam.

In the embodiment of FIGS. 17–21, given that a flat surface 1 replaces the unnumbered round tube of the embodiment of FIG. 2, the radiused roller of the FIG. 2 embodiment need not be used; rather, a bearing may be used on flat surface 1. As in the embodiment of FIG. 2, a second bearing may ride on flat surface 2, and a third bearing may ride on flat surface 3. In sum, three unillustrated bearings may be used in the embodiment of FIG. 27, as opposed to the one radiused roller and two illustrated bearings of the body of FIG. 2. Such bearings may be ball-bearings, roller-bearings, rubber wheels, and the like, depending on the intended use.

More particularly, FIGS. 17–21 illustrate an upper rail assembly 104 including a rail 106 and an interlocking sleeve assembly 110. Interlocking sleeve assembly or height adjustment leg 110 includes an upper portion 120 and a lower portion 140.

Upper portion 120 includes an outer member or sleeve or leg 124, an inner sleeve, member, or leg 128, and a middle member or sleeve or leg 132.

Upper outer leg 124 includes a lower face 136, middle leg 132 includes a lower face 138, and inner leg 128 includes a lower face 139.

Lower portion or base 140 includes an upright 144 and an extension 148 which may be disposed inwardly of upright 144.

A foot 152 may be provided, such as at the bottom of lower portion or base 140.

One or more holes 154 may be provided in foot 152.

As will be readily appreciated, unillustrated fasteners may be used to secure foot 152 and, hence, lower portion 140 to a support surface, such as the ground or the floor of the area where the device which includes upper rail assembly 104 such as a piece of food processing equipment, as may be found in a delicatessen of a grocery store, for example.

Figures 23, 24:
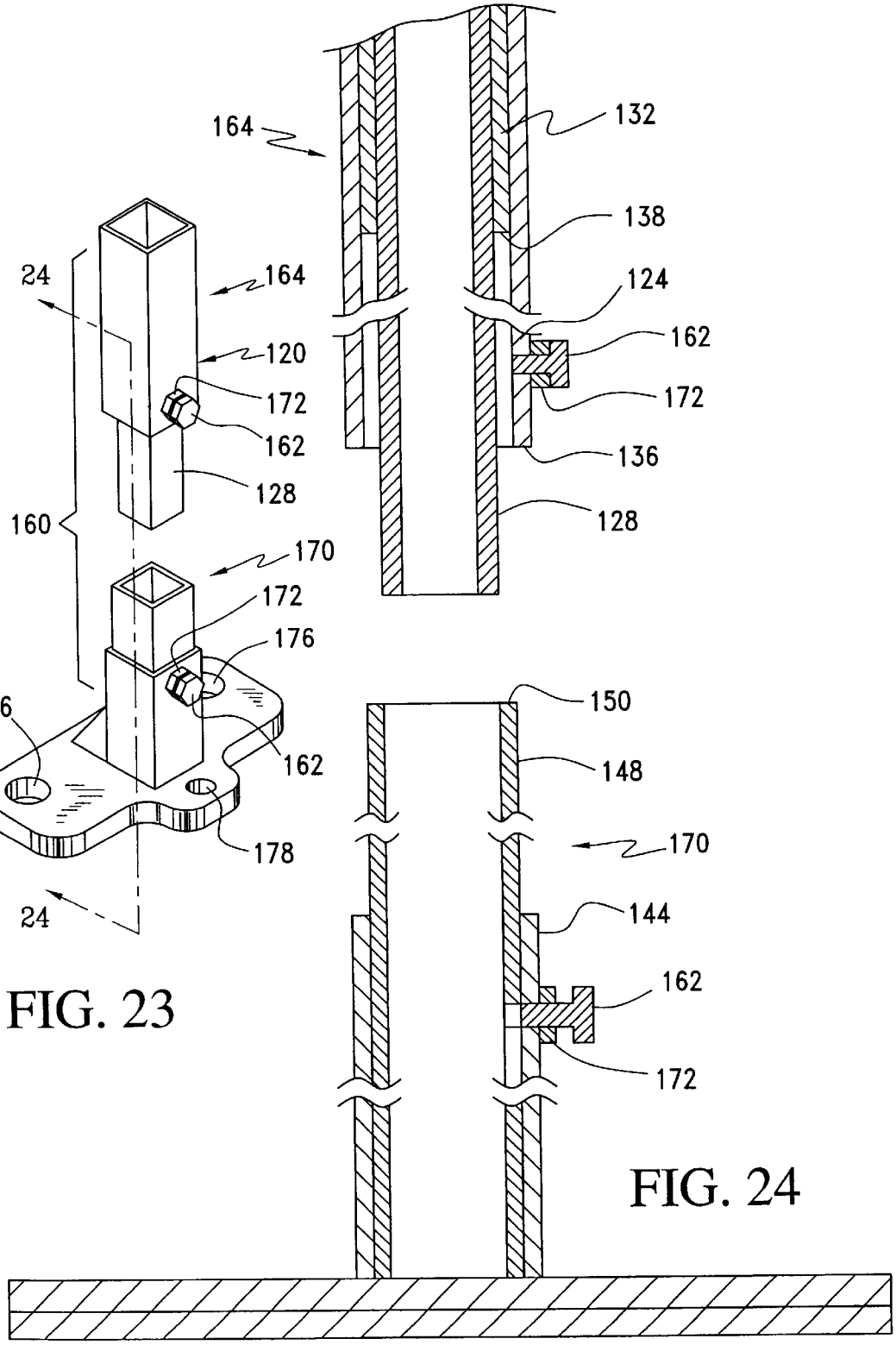
Figure 25:
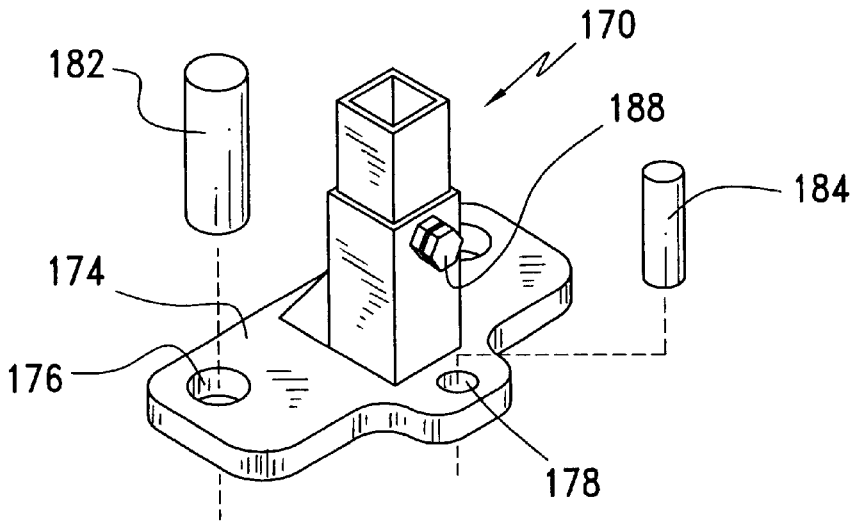

FIGS. 23–25 illustrate another preferred embodiment of an interlocking sleeve assembly 160.

Sleeve assembly 160 may include an upper portion 164 having one or more fasteners 162 which secure upper portion 164 to a lower portion 170.

One or more mating female fasteners 172 may be provided, and to which fasteners 162 may be attached. In that manner, upper portion 164 of the interlocking sleeve assembly may be detachably attached to lower portion 170 of the interlocking sleeve assembly or height adjustment leg 160.

Specifically, in use, when extension 148 is inserted between inner leg 128 and outer leg 124 of upper portion 164, while at the same time inner leg 128 is inserted into extension 148, fastener 162 may be tightened to press against an outer face of extension 148 to secure extension 148 relative to upper portion 164; i.e., relative to inner,leg 128 and outer leg 124.

At the same time, depending on the height to which the assembly is to be adjusted, and depending on the location of the fasteners 162 and 172 on lower portion 170, inner leg 128 of upper portion 164 may be detachably attached to lower portion 170 thanks to the lower fastener 162 pressing against an outer face of inner leg 128, as will be readily appreciated.

FIG. 25 illustrates lower portion 170 when fasteners, such as rods, lag bolts, and the like 182 and 184 are inserted through respective apertures 176 and 178 in order to secure enlarged foot 174 to the floor.

Figure 26:
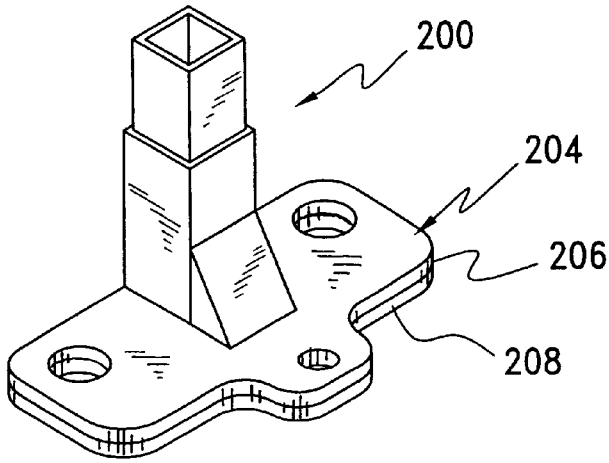

FIG. 26 illustrates a further preferred embodiment of a lower portion 200 that requires no fasteners for securing the upper portion of the height adjustable leg to lower portion

200. In this case, all the detachably attaching fasteners may be provided on the unillustrated upper portion 120 or 164 of the above described embodiments.

Still further, it is contemplated that, in the case where no height adjustability is expected, or height adjustability is provided in the machinery carried by the upper rail assembly, no fasteners might be required on either the upper portion or the lower portion of the interlocking sleeve assembly.

In addition, foot 204 may be made of two or more pieces, such as the illustrated upper plate 206 and lower plate 208. Plates 206 and 208 may be welded together.

It will be appreciated that many, if not all, of the elements of the assembly may be welded together, except in the case where height adjustability is desired.

Good results have been achieved by use of the three layer interlocking sleeve assembly.

It has been found that the adjustable height interlocking sleeve assembly provides better detachably attached height adjustability for tables, rail assemblies, and the like, while avoiding undesirable wobble (i.e., back and forth and side to side movement). In any of the embodiments additional fasteners along the height (e.g., length) of the adjustable height leg assembly are contemplated. For example, fasteners 162 and 172 may be provided on 2, 3, or 4 of the faces of outer leg 124 of upper portion 164.

Good results have been achieved when fastener 162 is made as a stainless steel bolt, and female fastener 172 was in the form of a correspondingly sized nut that had been welded to an outer face of outer leg 124, as may be seen in FIG. 24. Needless to say, a through hole will typically be provided in line with the threaded female portion of such a nut 172 in that case.

The system is contemplated for sliding slicer systems, rolling wrap stations, and tables which have one or more vertically extending legs to support the table surface.

The components may be made of 304 S series stainless steel tubing, such as round, square, and other rectangular tubing.

Components may be laser cut out of the same 304 series stainless steel plate, as required.

Good results have been achieved when a traveling scale has been placed on such an assembly in the form of an installed rail assembly.

The adjustable height leg may also be used when a single leg is used in the case where a rolling base is provided for the adjustable height leg, a table is provided on the upper portion of the adjustable height leg, and a piece of equipment such as an electronic scale is disposed on the table.

While this invention has been described as having a preferred design, it is understood that it is capable of further modifications, uses, and/or adaptations of the invention following, in general, the principle of the invention and including such departures from the present disclosure as come within the known or customary practice in the art to which the invention pertains and, as may be applied to the central features herein before set forth, and fall within the scope of the invention and of the limits of the appended claims.

I claim:

1. A piece of food processing equipment, comprising:

a) a rail;

b) a plurality of downwardly extending legs disposed on the rail;

c) at least one of the plurality of legs being a height adjustable leg;

d) the height adjustable leg including:

i) an outer leg;

ii) an inner leg disposed inwardly of the outer leg; and iii) a middle leg disposed between the outer leg and the inner leg;

e) the height adjustable leg including a base, the base having:

i) an upright;

ii) an extension disposed inwardly of the upright;

iii) the extension extending outwardly of the upright; and iv) the extension being sized for engaging with the middle leg of the height adjustable leg; and f) whereby, in use, the middle leg engages with the extension.

2. A device as in claim 1, wherein:

a) the extension of the base is sized for engaging with the outer leg of the height adjustable leg; and b) whereby, in use, the outer leg engages with the extension.

3. A device as in claim 2, wherein:

a) the outer leg includes a piece of tubing.

4. A device as in claim 2, wherein:

a) a support assembly is provided on the rail and is slidable along the rail.

5. A device as in claim 1, wherein:

a) the extension is sized for engaging an outer portion of the middle leg.

6. A device as in claim 5, wherein:

a) the outer leg is sized for engaging an outer portion of the extension.

7. A device as in claim 6, wherein:

a) a fastener is provided on the height adjustable leg, the fastener being disposed adjacent to one of the legs and the base for fixedly attaching the base relative to the one of the legs.

8. A device as in claim 7, wherein:

a) the fastener secures the outer leg to the extension.

9. A device as in claims 7, wherein:

a) the fastener secures the upright to the inner leg.

10. A device as in claim 9, wherein:

a) the rail is sized and configured for supporting a slidable scale.

11. A device as in claim 9, wherein:

a) the outer leg includes a piece of tubing.

12. A device as in claim 11, wherein:

a) the tubing has a substantially rectangular cross is section.

13. A device as in claim 12, wherein:

a) the tubing has a substantially square cross section.

14. A device as in claim 3, wherein:

a) the outer leg includes a piece of tubing.

15. A device as in claim 5, wherein:

a) the inner, middle, and outer legs include tubes; and b) the upright and extension comprise tubes.

16. A device as in claim 5, wherein:

a) the extension is sized for engaging an inner portion of the outer leg.

17. A device as in claim 16, wherein:

a) the extension is sufficiently long for engaging one or both of the inner leg and the outer leg.

18. A device as in claim 1, wherein:

a) the outer leg is sized for engaging an outer portion of the extension.

19. A device as in claim 1, wherein:

a) the rail is sized and configured for supporting a slidable scale.

20. A piece of food processing equipment, comprising:

a) provided on the piece of equipment a height adjustable leg;

b) the height adjustable leg including:

i) an outer leg;

ii) an inner leg disposed inwardly of the outer leg; and iii) a middle leg disposed between the outer leg and the inner leg;

c) the height adjustable leg including a base, the base having:

i) an upright;

ii) an extension disposed inwardly of the upright;

iii) the extension extending outwardly of the upright; and iv) the extension being sized for engaging with the middle leg of the height adjustable leg; and d) whereby, in use, the middle leg engages with the extension.

21. A device as in claim 20, wherein:

a) the extension of the base is sized for engaging with the outer leg of the height adjustable leg; and b) whereby, in use, the outer leg engages with the extension.

22. A device as in claim 21, wherein:

a) the extension is sized for engaging an outer portion of the middle leg.

* * * * *